US007510596B2

(12) United States Patent
Struble et al.

(10) Patent No.: US 7,510,596 B2
(45) Date of Patent: Mar. 31, 2009

(54) THERMAL PROCESSOR WITH CONTAMINANT REMOVAL CARTRIDGE

(75) Inventors: Kent R. Struble, Woodbury, MN (US); David J. McDaniel, Vdnais Heights, MN (US); John M. Nutter, Ramsey, MN (US)

(73) Assignee: Carestream Health, Inc., Rochester, NY (US)

( * ) Notice: Subject to any disclaimer, the term of this patent is extended or adjusted under 35 U.S.C. 154(b) by 345 days.

(21) Appl. No.: 11/315,863

(22) Filed: Dec. 22, 2005

(65) Prior Publication Data

US 2007/0144346 A1 Jun. 28, 2007

(51) Int. Cl.
*G03D 7/00* (2006.01)

(52) U.S. Cl. ..... 95/90; 96/134; 96/138; 55/385.1; 62/617; 396/565; 396/575; 396/579

(58) Field of Classification Search ..... 95/90, 95/143; 96/134, 138, 139, 151; 55/385.1; 62/617, 640; 396/565, 575, 579; 430/350; 219/216

See application file for complete search history.

(56) References Cited

U.S. PATENT DOCUMENTS

| | | | | |
|---|---|---|---|---|
| 4,059,409 | A * | 11/1977 | Barto et al. | 422/169 |
| 4,485,294 | A | 11/1984 | Rosenberg | |
| 4,693,588 | A * | 9/1987 | Yarbrough et al. | 399/93 |
| 5,047,798 | A * | 9/1991 | Yamamoto et al. | 355/405 |
| 5,469,238 | A | 11/1995 | Biegler | |
| 5,502,533 | A | 3/1996 | Biegler | |
| 5,600,396 | A | 2/1997 | Biegler et al. | |
| 5,641,344 | A * | 6/1997 | Takahashi et al. | 96/139 |
| 5,895,592 | A | 4/1999 | Struble et al. | |
| 2002/0135657 | A1 | 9/2002 | Sumi et al. | |
| 2004/0053174 | A1 | 3/2004 | Fukui | |
| 2006/0151457 | A1 * | 7/2006 | Rassatt et al. | 219/216 |

FOREIGN PATENT DOCUMENTS

| | | |
|---|---|---|
| JP | 05-045850 | 2/1993 |
| JP | 2001-154332 | 6/2001 |
| JP | 2003-043655 | 2/2003 |
| JP | 2003-190736 | 7/2003 |
| JP | 2003-215771 | 7/2003 |
| SU | 675390 | 7/1979 |

* cited by examiner

*Primary Examiner*—Frank M Lawrence

(57) ABSTRACT

A thermal processor includes an oven for thermally developing an imaging media which produces gaseous contaminants during development. The gaseous contaminants includes odorous portions and condensable portions which have a condensation temperature. A contaminant removal cartridge has a housing configured to couple to the oven, a heat exchanger, and a filter module. The heat exchanger receives from the oven at least a first air flow at a first temperature, wherein the first temperature is above the condensation temperature, and including gaseous contaminants. The heat exchanger cools the first air flow to a desired filtering temperature, which is below the condensation temperature, to condense and collect the condensable portion of the gaseous contaminants and form a filtering air flow. The filter module receives the filtering air flow, to collect the remaining condensed contaminants, and to absorb the odorous portion of the gaseous contaminants to form an exhaust air flow.

26 Claims, 5 Drawing Sheets

THERMAL PROCESSOR WITH CONTAMINANT REMOVAL CARTRIDGE

FIELD OF THE INVENTION

The present invention relates generally to an apparatus and method for thermally processing an imaging media, and more specifically to an apparatus and method for thermally developing an imaging media employing a contaminant removal cartridge to collect airborne contaminants produced by the development process.

BACKGROUND OF THE INVENTION

Photothermographic film generally includes a base material, such as a thin polymer or paper, typically coated on one side with an emulsion of heat sensitive materials, such as dry silver. Once the film has been subjected to photo-stimulation, such as by light from a laser of a laser imaging system, for example, the resulting latent image is developed through application of heat to the film to form a visible image.

Several types of processing machines have been developed for developing photothermographic film. One type employs a rotating heated drum having multiple pressure rollers positioned around the drum's circumference to hold the film in contact with the drum during development. Another type of processor, commonly referred to as a flat-bed processor, includes multiple rollers spaced to form a generally horizontal transport path that moves the photothermographic film through an oven. Regardless of their type, processors are typically designed to heat the photothermographic film to at least a desired processing temperature for a set time, commonly referred to as the dwell time, for optimal film development.

As the photothermographic film is heated, some types of emulsions produce gasses containing contaminants, such as fatty acids (FAZ), which may subsequently condense when coming in contact with cooler air or surfaces within the processor. When contacting cooler air or cooler surfaces, the gasses may condense and contaminants, fatty acids in particular, may become deposited on the photothermographic film and subsequently be transported to other processor components. These deposits can accumulate over time and can damage processor components, cause film jams within the processor, and cause visual defects in the developed image.

In efforts to reduce the occurrence of such problems, processors generally include systems designed to remove the gasses from the processor before the contaminants can condense. These systems generally include a duct or vent system designed to direct a stream of heated air and gasses from a processing chamber through some type of condensate accumulator and then through a filtering module before exhausting the air to the environment.

Condensate accumulators are generally designed to cool the air stream and cause contaminants to precipitate and collect on accumulator surfaces. Condensate accumulators take a variety of forms, ranging from condensation traps that simply mix ambient air with the heated air stream to various forms of heat exchangers. The cooled air stream is passed from the condensate accumulator through the filtering module. The filtering module typically includes an absorbent block which removes odorous materials before exhausting the air stream from the processor.

While the absorbent block of the filtering module is typically replaceable, the condensate accumulator generally remains affixed to the processor. Also, the condensate accumulator and filter module are typically positioned remotely from the processing chamber and require an extended duct system through which to receive gasses from the processing chamber. Due to its distance from the processing chamber, contaminants often condense and accumulate within the duct system. As a result, even though the filter module may be user replaceable, regular maintenance is generally required to remove contaminant build-up from within both the duct system and the condensate accumulator. Such maintenance can be costly and result in processor downtime.

It is evident that there is a need for improving thermal processors to reduce problems associated with contaminants produced during development of photothermographic film.

SUMMARY OF THE INVENTION

In one embodiment, the present invention provides a thermal processor including an oven for thermally developing an imaging media which produces gaseous contaminants during development, the gaseous contaminants including an odorous portion and a condensable portion which condenses at or below a condensation temperature, and a contaminant removal cartridge having a housing configured to selectively couple to the oven. The contaminant removal module includes, within the housing, a heat exchanger and a filter module. The heat exchanger is configured to receive from the oven at least a first air flow at a first temperature, wherein the first temperature is above the condensation temperature, and including gaseous contaminants. The heat exchanger is further configured to cool the first air flow to a desired filtering temperature, which is below the condensation temperature, so as to condense and collect substantially all of the condensable portion of the gaseous contaminants and form a filtering air flow. The filter module is configured to receive the filtering air flow, to collect substantially all remaining condensed contaminants, and to absorb substantially all of the odorous portion of the gaseous contaminants so as to form an exhaust air flow.

In one embodiment, the first temperature is substantially equal to a processing temperature of the oven. In one embodiment, the filter module includes an absorbent material configured to absorb the odorous portion of the gaseous contaminants from the filter air flow such that the exhaust air flow is substantially free of gaseous contaminants. In one embodiment, the desired filtering temperature is approximately equal to a temperature at which the absorbent material is most absorbent. In one embodiment, the desired exhaust temperature is approximately equal to an ambient temperature of an environment in which the thermal processor operates.

During operation of the thermal processor, substantially all condensable and all odor-causing gaseous contaminants produced by the imaging media during thermal development are collected and/or absorbed within the contaminant removal cartridge. Additionally, since the temperature of the first air flow is substantially at the processing temperature of the oven, condensation of gaseous contaminants within the oven or other internal components of processor 30 is substantially eliminated.

When the contaminant removal cartridge needs to be replaced, a user of the thermal processor is able to simply remove and replace the "used" contaminant removal cartridge with a "fresh" contaminant removal cartridge. Since collection of the gaseous contaminants is substantially confined to the user-replaceable contaminant removal cartridge, costly maintenance and downtime associated with cleaning condensed gaseous contaminants from within the thermal processor is substantially reduced. Furthermore, because substantially all of the condensable portion of the gaseous contaminants is collected in the heat exchanger, the effectiveness of the absorbent material is extended, thereby extending an expected life of the contaminant removal cartridge.

BRIEF DESCRIPTION OF THE DRAWINGS

The foregoing and other objects, features, and advantages of the invention will be apparent from the following more particular description of the embodiments of the invention, as illustrated in the accompanying drawings. The elements of the drawings are not necessarily to scale relative to each other.

DETAILED DESCRIPTION OF THE INVENTION

Figure 1:
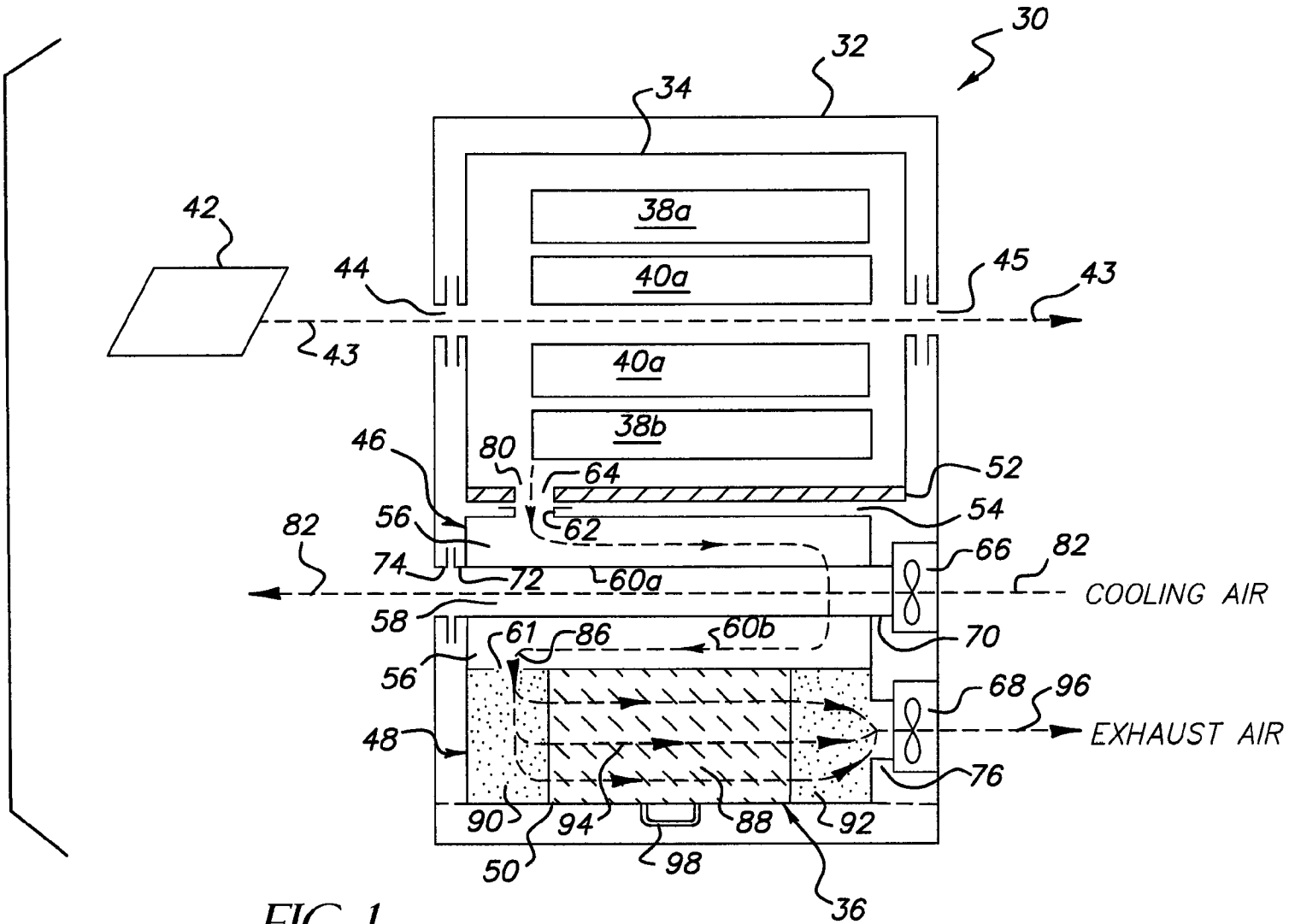
FIG. 1 is block diagram illustrating generally a thermal processor employing a contaminant removal cartridge according to the present invention.

The following is a detailed description of the preferred embodiments of the invention, reference being made to the drawings in which the same reference numerals identify the same elements of structure in each of the several figures.

FIG. 1 is a block diagram illustrating generally one embodiment of a thermal processor 30 including a user replaceable contaminant removal cartridge in accordance with the present invention. Thermal processor 30 includes an enclosure 32, an oven 34, and a contaminant removal cartridge 36 according to one embodiment of the present invention. Oven 34 includes a heat source 38 and a transport system 40. In operation, transport system 40 receives and transports exposed photothermographic media 42 through oven 34 along a transport path 43 from an entrance 44 to an exit 45. Heat source 38 heats imaging media 42 to at least a desired processing temperature to thermally develop the exposed image as it moves along transport path 44. As imaging media 42 is thermally developed, it produces gaseous contaminants including a portion which is condensable at or below a corresponding condensation temperature (e.g. FAZ) and an odor-causing portion (e.g. methyl ethyl ketone (MEK)).

Contaminant removal cartridge 36 includes a heat exchanger 46 and a filter module 48 positioned within a housing 50 which is configured to enable contaminant removal cartridge 36 to be selectively coupled to and removed from thermal processor 30. In one embodiment, housing 50 of contaminant removal cartridge 36 is configured to slideably insert into and couple to enclosure 32 so as to be proximate to and couple to oven 34 (i.e. an "installed" position). In one embodiment, thermal processor 30 includes an insulation layer 52 positioned between oven 34 and contaminant removal cartridge 36. In one embodiment, when in an installed position, contaminant removal cartridge 36 is positioned so as to maintain an air layer 54 between housing 50 and insulation layer 52. In one embodiment, insulation layer 52 comprises melamine insulation.

Although illustrated and described by FIG. 1 as being slideably inserted into enclosure 32, housing 50 of contaminant removal module cartridge 36 may be coupled to enclosure 32 and oven 34 in other fashions, such as external to enclosure 32, for example.

In one embodiment, heat exchanger 46 includes a contaminated air path or duct 56 and a cooling air duct 58 which share and are separated by one or more duct walls 60, illustrated as duct walls 60*a* and 60*b*, such that heat exchanger 46 comprises a "separated air-flow" heat exchanger. In one embodiment, duct walls 60 comprise a material having a high thermal conductivity. In one embodiment, ducts walls 60 comprise aluminum. In one embodiment, contaminated air duct 56 is coupled to filter module 48 by a transfer vent 61.

In one embodiment, housing 50 is configured to selectively couple to oven 34 such that an exhaust inlet 62 through housing 50 from contaminated air duct 56 of heat exchanger 46 aligns and couples to an exhaust outlet 64 of oven 34. In one embodiment, as illustrated by FIG. 1, thermal processor 30 includes a supply fan 66 and an exhaust fan 68. In one embodiment, when in an installed position, a cooling air inlet 70 through housing 50 to one end of cooling air duct 58 of heat exchanger 46 is configured to align with and communicatively couple to supply fan 66, and a cooling air outlet 72 through housing 50 from the other end of cooling air duct 58 is configured to align with and couple to a cooling vent 74 through enclosure 32. Similarly, an exhaust vent 76 through housing 50 from filter module 48 is configured to align with and to communicatively couple to exhaust fan 68.

In one embodiment, exhaust fan 68 is configured to create a vacuum that creates an air flow from oven 34 through contaminant removal cartridge 36 and which is exhausted from enclosure 32 of thermal processor 30 via exhaust fan 68. As such, in one embodiment, contaminated air duct 56 of heat exchanger 46 is configured to receive a processor air flow 80 from oven 34 via exhaust outlet 64 and exhaust inlet 62, wherein processor air flow 80 is substantially at the desired processing temperature and includes the gaseous contaminants produced by imaging media 42. In one embodiment, the desired processing temperature is approximately 125° C.

Supply fan 66 is configured to provide a cooling air flow 82 at a cooling air temperature through cooling air duct 58 with cooling air flow 82 entering at cooling air inlet 70 and exiting via cooling air outlet 72 and cooling vent 74 through enclosure 32. In one embodiment, cooling air flow 82 comprises air from an environment in which thermal processor 30 is located. In one embodiment, the cooling air temperature is at an ambient temperature of the environment in which thermal processor 30 is located. In one embodiment, cooling air flow 82 may be provided by an external device (not illustrated) configured to provide chilled air, such that the cooling air temperature is less than the ambient temperature.

As processor air flow 80 flows through contaminated air duct 56 toward filter module 48, heat is transferred from processor air flow 80 to cooling air flow 82 via thermo-conductive walls 60, thereby reducing the temperature of processor air flow 80. When the temperature of processing air flow 80 reaches and drops below the condensation temperature of the condensable portion of the gaseous contaminants (e.g. FAZ), the FAZ and other condensable contaminants begin to condense and collect on the internal surfaces of contaminated air duct 56. In one embodiment, heat exchanger 46 is configured to cool processor air flow 80 such that substantially all of the condensable portion of the gaseous contaminants precipitate and collect on the internal walls of contaminated air duct 56.

In one embodiment, a flow rate of processor air flow 80 and a flow rate of cooling air flow 82 are configured so that a heat transfer rate from processor air flow 80 to cooling air flow 82 is such that filtering air flow 86 is at a temperature substantially equal to a desired filter temperature as it enters filter module 48 via transfer vent 61 from heat exchanger 46. In one embodiment, the flow rate of cooling air flow 82 ranges from five to fifteen times the flow rate of processor air flow 80.

In one embodiment, as illustrated by FIG. 1, filter module 48 includes an absorbent block 88, an intake manifold 90, and an exhaust manifold 92. Intake manifold 90 is configured to receive and distribute filtering air flow 86 across absorbent block 88 so that filtering air flow 86 is drawn evenly across absorbent block 88, as indicated by filtering air flows 94. In one embodiment, intake manifold 90 and exhaust manifold 92 comprise open-cell foam.

In one embodiment, absorbent block 88 comprises an absorbent material configured to absorb the odor-causing portion of the gaseous contaminants, including MEK, for example, as filtering air flows 94 are drawn through to exhaust manifold 92. In one embodiment, absorbent block 88 comprises activated carbon. In one embodiment, absorbent block 88 most effectively absorbs odor-causing contaminants when operating at or below a maximum operating temperature. In one embodiment, absorbent block 88 has a maximum operating temperature of approximately 50° C.

As such, in one embodiment, heat exchanger 46 is configured to provide filtering air flow 86 at a desired filter temperature which is at or below the maximum operating temperature of absorbent block 88. In one embodiment, heat exchanger 46 provides filtering air flow 86 at a desired filter temperature which is at or below approximately 50° C.

In one embodiment, in addition to absorbing the odor-causing portion of the gaseous contaminants, filter module 48 is configured to collect substantially all condensed contaminants (e.g. FAZ) that may be remaining in filtering air flow 86. As such, in one embodiment, exhaust manifold 92 of filter module 48 is configured to receive filtering air flows 94 after passing through absorbent block 88 and to provide an exhaust air flow 96 from thermal processor 30 via exhaust vent 76 and exhaust fan 68, where exhaust air flow 96 is substantially free of gaseous contaminants. It is noted that filter module 48 absorbs heat from filtering air flows 86 and 94 such that exhaust air flow 96 is at a temperature which is less than the desired filter temperature.

As described above, during operation of thermal processor 30, substantially all condensable gaseous contaminants (e.g. FAZ) and all odor-causing gaseous contaminants (e.g. MEK) produced during thermal development of imaging media in oven 34 are collected and/or absorbed within contaminant removal cartridge 36. Additionally, since contaminant removal cartridge 36 is positioned proximate to oven 34 to minimize the travel distance of processor air flow 80 from oven 34 to heat exchanger 46, the temperature of processor air flow 80 is substantially at the desired processing temperature upon entering contaminated air duct 56, thereby substantially eliminating condensation of gaseous contaminants within oven 34 or other internal components of processor 30.

When contaminant removal cartridge 36 has collected an amount of gaseous contaminants such that it begins to lose its effectiveness, such as after predetermined number of operating hours or after a certain amount of imaging media has been thermally developed, a user of thermal processor 30 is able to simply remove and replace a "used" contaminant removal cartridge 36 with a "fresh" contaminant removal cartridge. Since collection of gaseous contaminants is substantially confined to user-replaceable contaminant removal cartridge 36, costly maintenance and downtime associated with cleaning condensed gaseous contaminants from thermal processor 30 is substantially reduced. Additionally, because substantially all of the condensable portion of the gaseous contaminants is collected in heat exchanger 46, absorbent block 88 does not become quickly coated with condensable contaminants so that the effectiveness of absorbent block 88 is extended, thereby extending the life of contaminant removal cartridge 36.

In one embodiment (not illustrated) housing 50 includes a grip or handhold mechanism 98, such as a handle, for example, to enable a user to more easily couple/de-couple contamination removal cartridge 36 to/from thermal processor 30. In one embodiment, housing 50 comprises ABS plastic, which reduces a weight and cost of contaminant removal cartridge 36.

Figure 2:
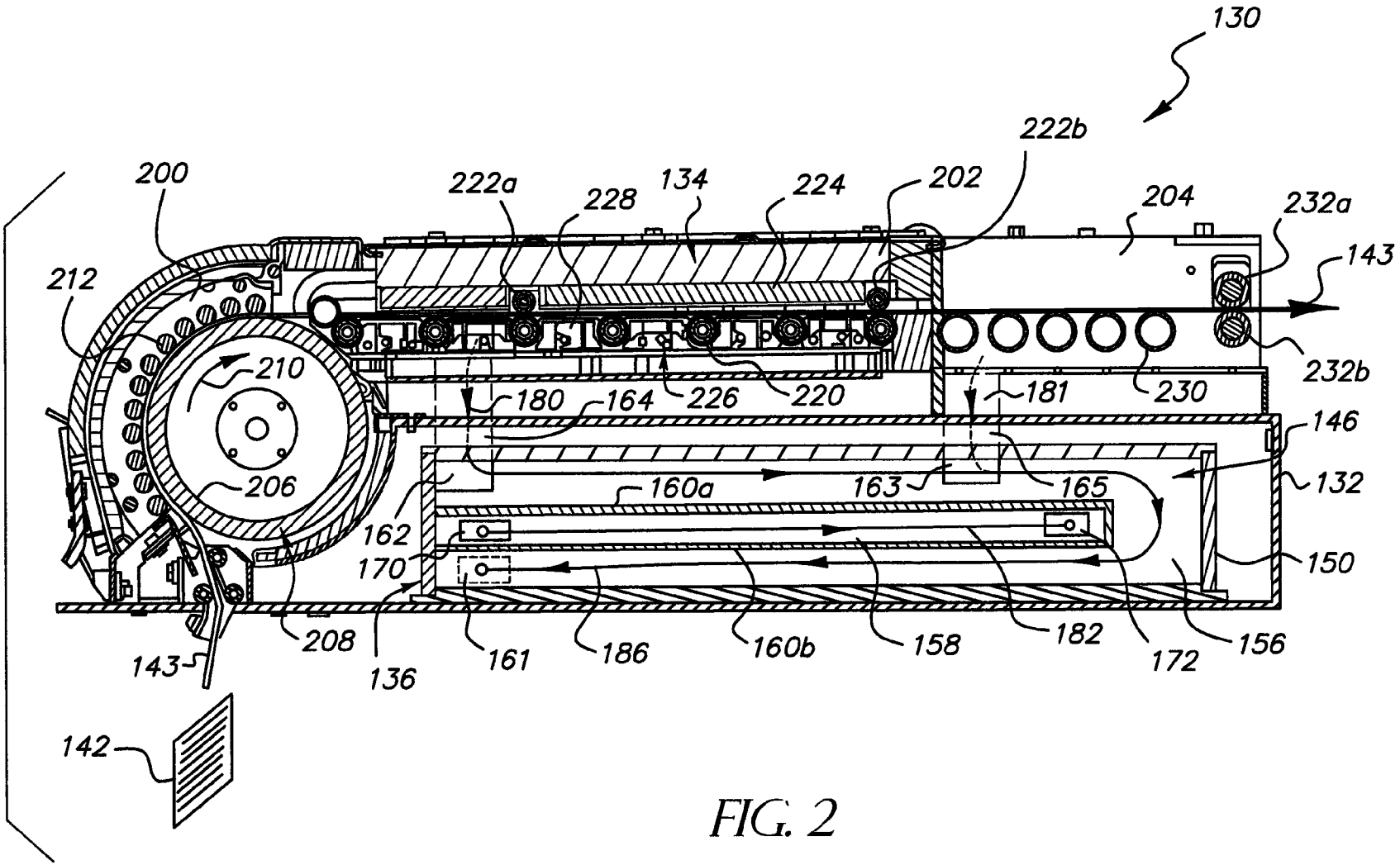
FIG. 2 is a cross-sectional view illustrating one embodiment of a thermal processor employing a contaminant removal module according to the present invention.

FIG. 2 is a cross-sectional view of one embodiment of a thermal processor 130 according to the present invention. Processor 130 is a combination of what are generally referred to as a drum-type processor and a flatbed-type processor. An example of such a drum/flatbed-type processor is disclosed in U.S. Pat. No. 7,317,468, entitled "Thermal Processor Employing Drum and Flatbed Technologies", assigned to the same assignee as the present invention, which is herein incorporated by reference.

Processor 130 includes an overall enclosure 132, an oven 134, and a contaminant removal cartridge 136. Oven 134 includes a drum processor section 200 that functions as a pre-dwell section, a flatbed processor section 202 that functions as a dwell section, and a cooling section 204. An imaging media, such as imaging media 142, is thermally developed by thermal processor 130 by moving imaging media 142 along a transport path 143 (illustrated by a heavy line) through drum processor 200, flatbed processor 202, and cooling section 204.

Contaminant removal cartridge 136 includes a heat exchanger 146 and a filter module 148 (see FIGS. 3 and 4) within a housing 150. Heat exchanger 146 includes a contaminated air duct 156 and a cooling air duct 158 which share and are separated by one or more duct walls, illustrated as duct walls 160*a* and 160*b*. Contaminated air duct 156 includes a transfer vent 161 to filter module 148, an exhaust inlet 162, and an exhaust inlet 163. Cooling air duct 158 includes a cooling air inlet 170 and a cooling air outlet 172. In one embodiment, housing 150 of contaminant removal cartridge 136 is configured to slideably insert into enclosure 132 of thermal processor 130 such that exhaust inlet 162 couples to an exhaust outlet 164 from flatbed processor 202 and exhaust inlet 163 couples to an exhaust outlet 165 from cooling section 204.

Drum processor section 200 includes a circumferential heater 206 positioned within an interior of a rotatable processor drum 208 that is driven so as to rotate as indicated by directional arrow 210. A plurality of pressure rollers 212 is circumferentially arrayed about a segment of processor drum 208 so as to hold imaging media 142 in contact with processor drum 208 as it rotates and moves imaging media 142 along transport path 143. In one embodiment, circumferential heater 206 heats processor drum 208 to a desired pre-dwell temperature. In one embodiment, the pre-dwell temperature is within a range from approximately 120° C. to approximately 135° C. In one embodiment, the desired pre-dwell temperature is approximately 125° C.

Flatbed processor 202 includes a plurality of rollers, such as illustrated at 220, positioned to form a planar path through flatbed processor 202. One or more rollers 220 are driven to move image media through flatbed processor 202 along transport path 143. A pair of idler rollers, 222*a* and 222*b*, are positioned to form a nip with a corresponding roller to ensure that imaging media 142 remains in contact with rollers 220 and does not lift from transport path 143.

Flatbed processor further includes a heat source 224 (e.g. a resistive heat blanket) and a heat plate 226 to heat imaging media 142 as it moves through flatbed processor 202. In one embodiment, as illustrated in FIG. 2, heat plate 226 is formed to partially wrap around rollers 220 so that rollers 220 are partially "nested" within heat plate 226. In one embodiment, flatbed process 202 heats imaging media 142 to a desired development or dwell temperature. In one embodiment, the desired development temperature is within a range from approximately 120° C. to approximately 135° C. In one embodiment, the desired development temperature is approximately 125° C.

In one embodiment, as illustrated by FIG. 2, heat plate 226 is an extruded aluminum structure including internal exhaust air passages, such as illustrated at 228, configured to exhaust contaminated air from flatbed processor 202 via openings in heat plate 226 along a length of each roller 220. Internal exhaust passages 228 are coupled to exhaust outlet 164 which together direct a processor air flow 180 to heat exchanger 146 via exhaust inlet 162, wherein processor air flow 180 is substantially at the development temperature and includes gaseous contaminants similar to those described above with respect to FIG. 1.

A system similar to that described above employing internal passages for exhausting air from flatbed processor 202 is described in U.S. Pat. No. 5,895,592 to Struble et al., assigned to the same assignee as the present invention, which is herein incorporated by reference. In one embodiment, the internal exhaust air passages also exhaust air from a junction region between drum processor 200 and flatbed processor 202 where transport path 143 transitions from processor drum 208 to rollers 220 as gaseous contaminants trapped between imaging media 142 and processor drum 208 are released in this region.

Cooling section 204 includes a plurality of transport rollers 230 to move imaging media 142 through cooling section 204 and a pair of nip rollers, 232*a* and 232*b*, to direct imaging media 142 out of cooling section 204 along transport path 143. Cooling section 204 is configured to cool imaging media 142 from the processing temperature of flatbed processor 202 so as to cause thermal development of imaging media 142 to cease.

In one embodiment, as illustrated by FIG. 2, exhaust outlet 165 from cooling section 204 is positioned proximate to a junction between cooling section 204 and flatbed processor 202 as a majority of gaseous contaminants produced by imaging media 142 before thermal processing is ceased are emitted in this junction region. A cooling section air flow 181 is directed to heat exchanger 146 via exhaust outlet 165 and exhaust air inlet 163, wherein cooling section air flow 181 includes gaseous and particulate contaminants and is at a temperature below that of processor air flow 180. In one embodiment, cooling section air flow 181 is at a temperature within a range from 50° C. to 90° C. In one embodiment, cooling section air flow is at a temperature of approximately 80° C.

Processor air flow 180 enters contaminated air duct 156 via exhaust inlet 162 and combines with cooling section air flow 181 entering contaminated air duct 156 via exhaust inlet 163 to form a filtering air flow 186 which is directed to filter module 148 (see FIGS. 3-5) via transfer vent 161. Cooling air flow 182 enters cooling air duct 158 via cooling air inlet 170 and exits via cooling air outlet 172.

Figure 3:
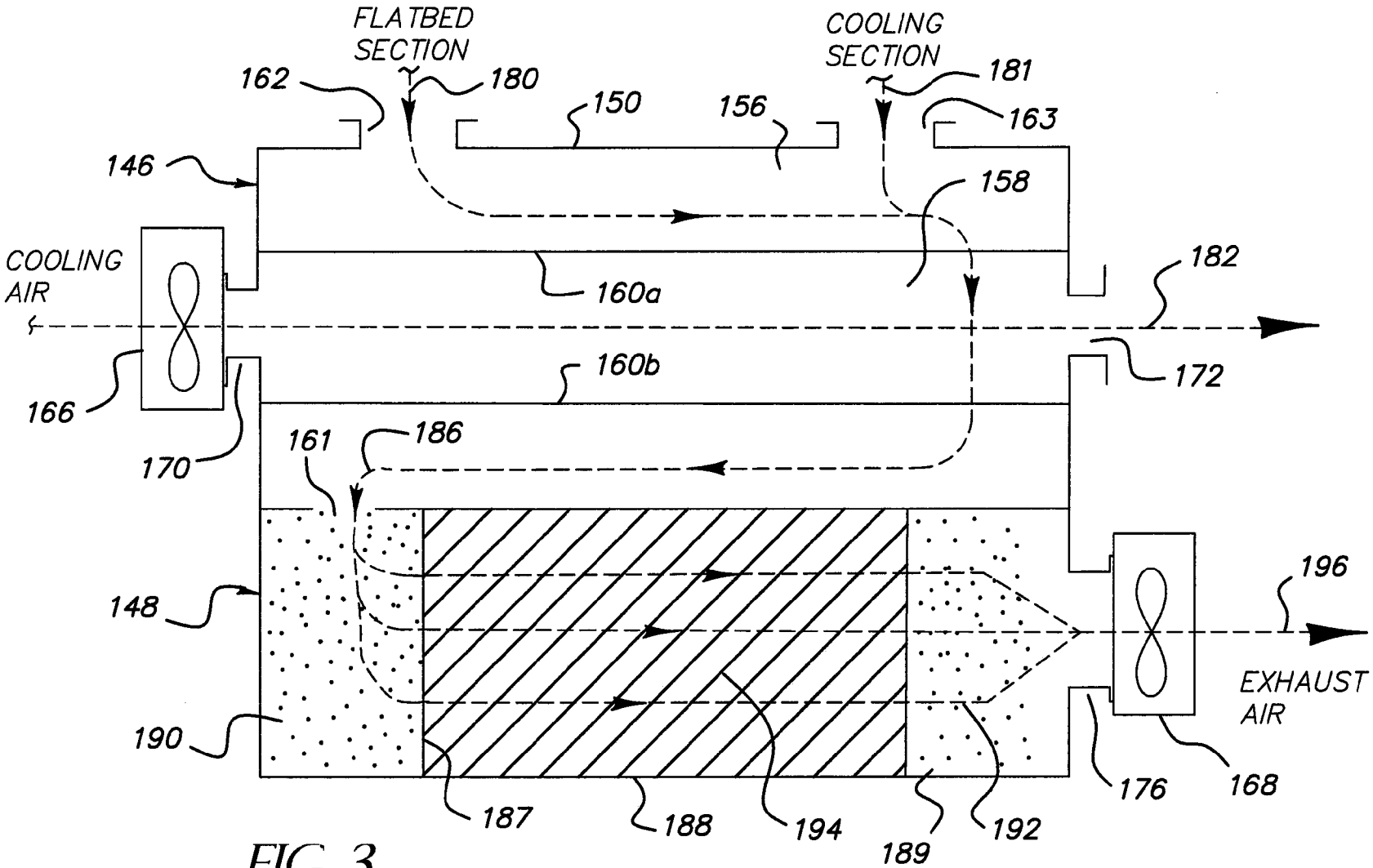
FIG. 3 is a schematic diagram illustrating generally one embodiment of a contaminant removal cartridge for use with the thermal processor of FIG. 2.

FIG. 3 is a schematic diagram illustrating generally and describing the operation of one embodiment of contaminant removal cartridge 136 of FIG. 2. Processing air flow 180 enters contaminated air duct 156 from flatbed processor 202 via exhaust inlet 162 at a temperature substantially equal to the processing temperature of flatbed processor 202. In one exemplary embodiment, processing air flow 180 enters heat exchanger 146 at approximately 125° C. Cooling section air flow 181 enters contaminated air duct 156 from cooling section 204 via exhaust inlet 163. In one embodiment, cooling section air flow 181 enters heat exchanger 146 at approximately 80° C.

Exhaust fan 168 draws processing air flow 180 and cooling section air flow 181 into heat exchanger 146 to form filtering air flow 186, and draws filtering air flow 186 through filter module 148 to form exhaust air flow 196. In one embodiment, exhaust fan 168 causes processing air flow 180 and cooling section air flow 181 to each flow at a rate of approximately 1 CFM (cubic feet per minute) such that filtering air flow 186 and exhaust air flow 196 each flow at a rate of approximately 2 CFM. A supply fan 166 provides cooling air flow 182 through cooling air duct 158 from cooling air inlet 170 to cooling air outlet 172. In one embodiment, supply fan 166 provides cooling air flow 182 at a flow rate of approximately 10 CFM.

As processing air flow 180 travels through contaminated air duct 156, heat is transferred to cooling air flow 182 via thermally conductive duct wall 160*a*. In one embodiment, as processing air flow 180 merges with cooling section air flow 181 to form filtering air flow 186, the temperature of processing air flow 180 is approximately equal to the temperature of cooling section air flow 181. As filtering air flow 186 travels through contaminated air duct 156, heat continues to be transferred to cooling air flow 182 via duct walls 160*a* and 160*b* such that the temperature of filtering air flow 186 is substantially equal to a desired filter temperature. In one exemplary embodiment, wherein processing air flow 180 has a temperature of approximately 125° C., cooling section air flow 181 has a temperature of approximately 80° C., and cooling air flow 182 has an ambient temperature of approximately 40° C., heat exchanger 146 is configured to provide a filtering air flow 186 to filtering module 148 having a temperature at or below 50° C.

In a fashion similar to that described above with reference to FIG. 1, as processing air flow 180, cooling section air flow 181, and filtering air flow 186 are cooled while flowing through contaminated air duct 156, substantially all of a condensable portion of the gaseous contaminants precipitate and collect on the walls of contaminated air duct 156 such that filtering air flow 186 is substantially free of condensable gaseous contaminants prior to entering filter module 148 from heat exchanger 146 via transfer vent 161.

Filter module 148 includes an absorbent block 188, an intake manifold 190, and an exhaust manifold 192. In one exemplary embodiment, absorbent block 188 is a block of granulated activated charcoal. In one embodiment, intake and exhaust manifolds 190 and 192 each consist of an open-cell foam material. As filtering air flow 186 enters intake manifold 190 via transfer vent 161, intake manifold 190 serves to provide a substantially evenly distributed air pressure across a surface 187 of absorbent block 188 so that filtering air flow 186 is pulled in a substantially even fashion across a cross-section of absorbent block 188 by exhaust fan 168. This evenly distributed filtering air flow is illustrated by multiple air flows 194.

Similarly, exhaust manifold 192 serves to provide a substantially evenly distributed air pressure across a surface 189, which is opposite absorbent block 188 from surface 187.

Exhaust manifold 192 receives filtering air flows 194 after passing through absorbent block 188 and provides exhaust air flow 196 to exhaust fan 168.

In a fashion similar to that described above with reference to FIG. 1, as filtering air flow 186 is drawn through filtering module 148, substantially all of a remaining portion of the condensable gaseous contaminants collect within filter module 148 and substantially all of an odor-causing portion of the gaseous contaminants are absorbed by absorbent block 188. Additionally, filtering air flow 186 continues to be cooled from the desired filtering temperature as it is drawn through filter module 146. As such, exhaust fan 168 provides an exhaust air flow 196 that is substantially free of gaseous contaminants produced by imaging media 142 during the thermal development process and at a temperature below the desired filtering temperature.

Figure 4:
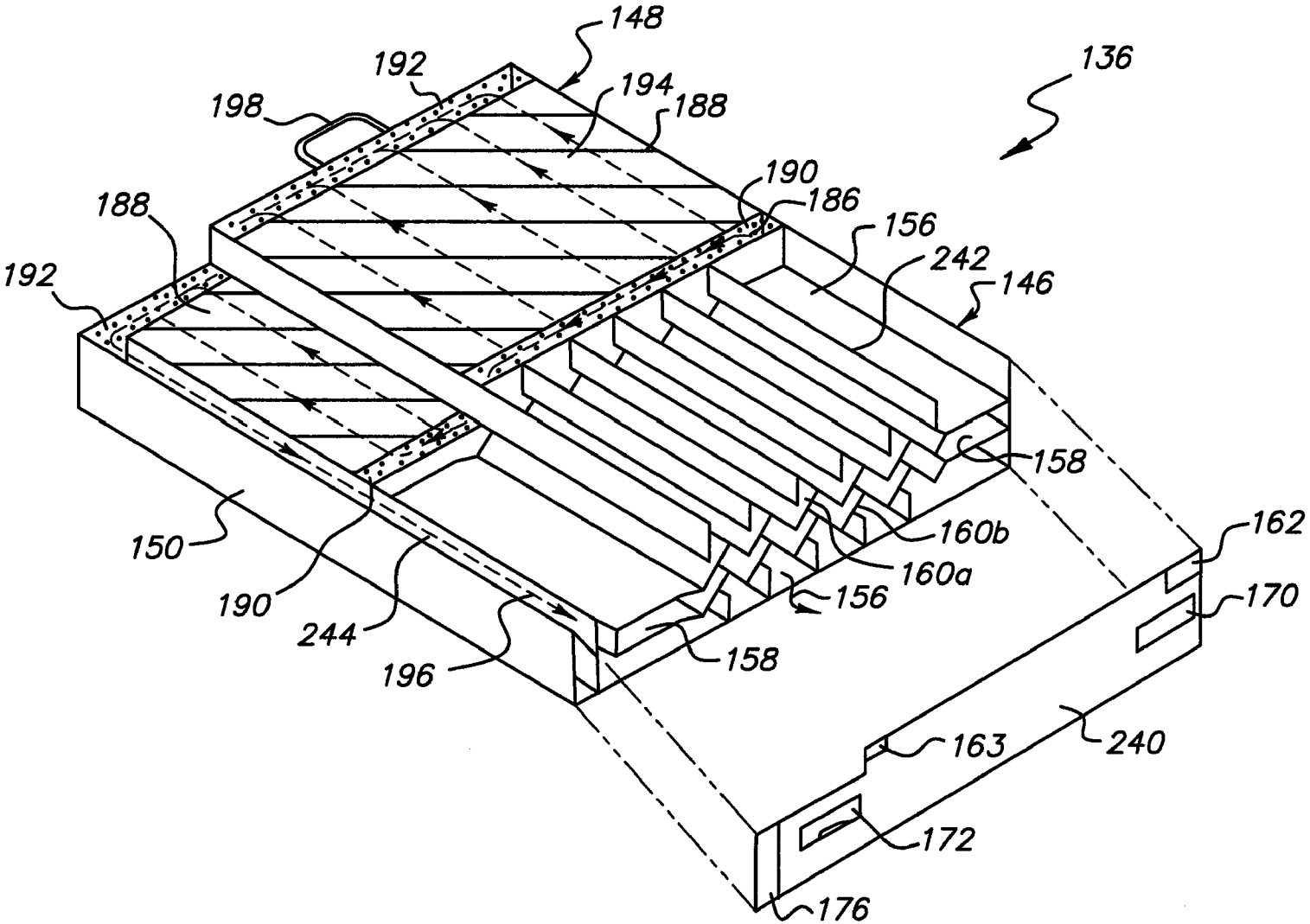
FIG. 4 is a perspective view illustrating one exemplary embodiment of the contaminant removal cartridge of FIG. 3.

FIG. 4 is a perspective view illustrating one exemplary embodiment of the contaminant removal cartridge 136 of FIGS. 2 and 3. To aid in describing contaminant removal cartridge 136, a rear cover 240 and a top cover (not shown) are removed from housing 150. In one embodiment, as illustrated by FIG. 4, cooling air duct 158 is positioned between or "sandwiched" between a U-shaped contaminated air duct 156. In one exemplary embodiment, duct walls 160*a* and 160*b*, which are shared by contaminated air duct 156 and cooling air duct 158 are "corrugated" in shape, with contaminated air duct 156 further including a number fins 242 at the "valleys" of duct walls 160*a* and 160*b* so as to cause processor air flow 180, cooling section air flow 181, cooling air flow 182, and filtering air flow 186 to flow in an undulating or "serpentine" fashion through heat exchanger 146 (see also FIG. 5 below).

In one exemplary embodiment, housing 150 is constructed of a plastic material having thermal characteristics such that the housing will not degrade when exposed to the processing temperatures associated with thermal processor 130. In one embodiment, the housing consists of glass-filled polycarbonate. In one embodiment, housing 150 consists of a combination of plastic and metal. In one embodiment, duct walls 160*a* and 160*b* are constructed of a material having high thermal conductivity characteristics. In one embodiment, duct walls 160*a* and 160*b* are constructed of aluminum. In one embodiment, housing 150 includes a handle 198 which enables a user to more easily insert/remove contaminant removal cartridge 136 into/from thermal processor 130.

Filtering air flow 186 enters intake manifold 190 from contaminated air duct 156 (see FIG. 5) where it is evenly distributed and flows through absorbent block 188 to exhaust manifold 192, as illustrated by filtering air flows 194. In one exemplary embodiment, contaminant removal module 136 includes an exhaust air channel 244. Exhaust channel 244 receives exhaust air flow 196 from exhaust manifold 192 and directs exhaust air flow 196 to exhaust vent 176 at rear cover 240.

Figure 5:
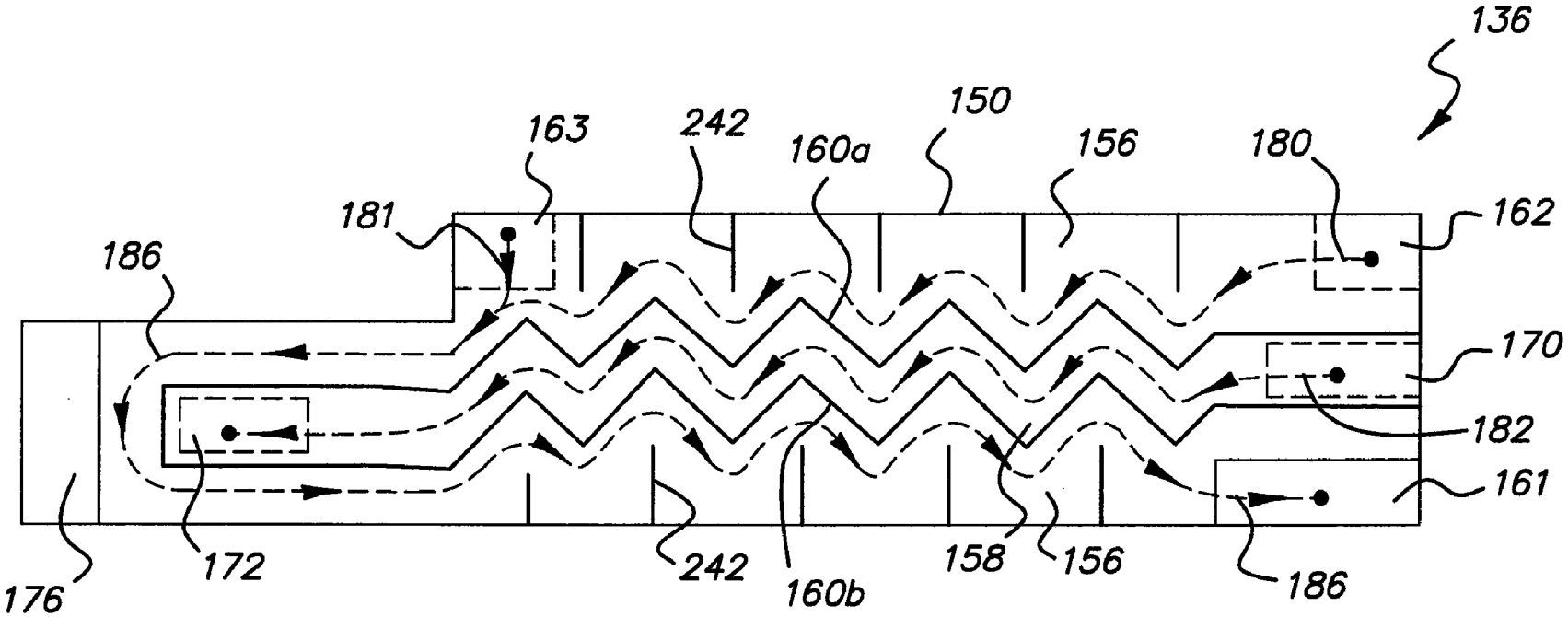
FIG. 5 is a cross-sectional view of the contaminant removal cartridge of FIG. 4.

FIG. 5 is cross-sectional view of contaminant removal cartridge 136 of FIG. 4 with rear cover 240 removed and illustrates in more detail air flows through heat exchanger 146. As illustrated, duct walls 146 are corrugated in shape with cooling air duct 158 positioned between a U-shaped contaminated air duct 156. Fins, such as illustrated by fins 242, extend from housing 150 into contaminated air duct 156 approximately at "valleys" in the corrugated shape of duct walls 160*a* and 160*b*. Processing air flow 180 and cooling section air flow 181 respectively enter contaminated air duct 156 via exhaust inlets 162 and 163.

The corrugated shape of duct walls 160*a* and 160*b* and fins 242 cause processing air flow 180 and filtering air flow 186 to travel in an undulating or serpentine fashion through contaminated air duct 156 before exiting to filter module 148 via transfer vent 161. Similarly, the corrugated shape of duct walls 160*a* and 160*b* causes cooling air flow 182 to travel in a serpentine fashion through cooling air duct 158 from cooling air inlet 170 to cooling air outlet 172. The corrugated shapes of contaminated air duct 156 and cooling air duct 158 increases the travel distance of processing air flow 180, cooling air flow 182, and filtering air flow 186 through heat exchanger 146 and increases the contact area of duct walls 160*a* and 160*b* between of contaminated air duct 156 and cooling air duct 158. As a result of the corrugated shape and serpentine air flows, heat exchanger 146 is able to be more efficiently and more effectively transfer heat to cooling air flow 182 from processing air flow 180, cooling section air flow 181, and filtering air flow 186 than if employing planar duct walls.

The invention has been described in detail with particular reference to certain preferred embodiments thereof, but it will be understood that variations and modifications can be effected within the spirit and scope of the invention.

What is claimed is:

1. A thermal processor, comprising:

an oven for thermally developing an imaging media which produces gaseous contaminants during development including an odorous portion and a condensable portion which condenses at or below a condensation temperature, the oven having a dwell section and a cooling section; and a contaminant removal cartridge having a housing configured to selectively couple to the oven, and including within the housing:

a heat exchanger configured to receive a first air flow at a first temperature from the dwell section and a second air flow at a second temperature from the cooling section downstream of the first air flow, the first and second temperatures being above the condensation temperature and the first and second air flows including gaseous contaminants, the heat exchanger further configured to cool the first air flow to the second temperature before mixing the first and second air flows and to cool the mixed air flow to a desired filtering temperature, which is below the condensation temperature, so as to condense and collect substantially all of the condensable portion of the gaseous contaminants therefrom to form a filtering air flow; and a filter module configured to receive the filtering air flow, to collect substantially all remaining condensed contaminants, and to absorb substantially all of the odorous portion of the gaseous contaminants therefrom to form an exhaust air flow.

2. The thermal processor of claim 1, wherein the first temperature is substantially equal to a processing temperature of the oven.

3. The thermal processor of claim 1, wherein the filter module includes an absorbent material configured to absorb the odorous portion of the gaseous contaminants from the filtering air flow.

4. The thermal processor of claim 3, wherein the absorbent material comprises activated charcoal.

5. The thermal processor of claim 3, wherein the desired filtering temperature is at or below a maximum operating temperature associated with the absorbent material.

6. The thermal processor of claim 1, wherein the heat exchanger includes:

a contaminated air duct configured to receive the first and second air flows and to provide the filtering air flow; and a cooling air duct configured to receive a cooling air flow at a cooling air temperature, wherein the cooling air duct is in thermal communication with the contaminated air duct such that the cooling air flow absorbs heat from the first air flow so that the filtering air flow is approximately at the desired filtering temperature.

7. The thermal processor of claim 6, wherein the cooling air temperature is substantially equal to an ambient temperature of an environment in which the thermal processor operates.

8. The thermal processor of claim 1, wherein the first temperature is in a range from approximately 110° C. to approximately 135° C.

9. The thermal processor of claim 1, where the second temperature is in a range from approximately 50° C. to approximately 90° C.

10. The thermal processor of claim 1, wherein the desired filtering temperature ranges from approximately 45° C. to approximately 55° C.

11. The thermal processor of claim 1, wherein the desired filtering temperature does not exceed 50° C.

12. The thermal processor of claim 1, wherein the first air flow and second air flow each have a flow rate of approximately one cubic foot per minute, and wherein a flow rate of the filtering air flow is approximately equal to a sum of the flow rates of the first and second air flows.

13. The thermal processor of claim 12, wherein the cooling air flow has a flow rate in a range from approximately five to fifteen times greater than a flow rate of the first air flow.

14. A thermal processor, comprising:

an oven including a dwell section having a first exhaust outlet and a cooling section having a second exhaust outlet;

a supply fan;

an exhaust fan;

an enclosure having a cooling vent, wherein the oven, supply fan, and exhaust fan are positioned within the enclosure; and a contaminant removal cartridge having a housing and including substantially therein:

a heat exchanger having a first exhaust inlet, a second exhaust inlet, a cooling air inlet, and a cooling air outlet through the housing; and a filter module coupled to the heat exchanger and having an exhaust vent in the housing, wherein the housing is configured to selectively couple to the oven and enclosure such that the first exhaust inlet, the second exhaust inlet, the cooling air inlet, the cooling air outlet, and the exhaust vent respectively align with and couple to the first exhaust outlet, the second exhaust outlet, the supply fan, the cooling vent, and the exhaust fan when the heat exchanger is selectively coupled to the oven and the enclosure.

15. The thermal processor of claim 14, wherein the thermal processor comprises a combination of a drum processor and a flatbed processor, wherein the flatbed processor comprises the dwell section.

16. The thermal processor of claim 14, wherein the housing comprises a plastic material.

17. The thermal processor of claim 14, wherein the heat exchanger includes a contaminated air duct coupled between the exhaust outlet and the filter module and a cooling air duct coupled between the cooling air inlet and the cooling air outlet, and wherein the contaminated air duct and cooling air duct share one or more duct walls having a high thermal conductivity.

18. The thermal processor of claim 17, wherein the shared duct walls comprise aluminum.

19. The thermal processor of claim 14, wherein the filter module comprises:

an intake manifold communicatively coupled to the heat exchanger;

an exhaust manifold coupled to the exhaust vent; and an absorbent block positioned between the intake manifold and the exhaust manifold, wherein the intake manifold and exhaust manifold are configured to evenly distribute an air flow through the absorbent block.

20. The thermal processor of claim 19, wherein the intake manifold and the exhaust manifold each comprise an open-cell foam material.

21. The thermal processor of claim 14, including an insulating material positioned between the oven and the contaminant removal cartridge.

22. The thermal processor of claim 21, wherein an air layer is maintained between the contaminant removal cartridge and the insulating material when the housing is selectively coupled to the oven and the enclosure.

23. The thermal processor of claim 14, wherein the housing is configured to slideably insert into the enclosure and to selectively couple to the oven and the enclosure.

24. A method of operating a thermal processor including an oven for thermally developing an imaging media which produces gaseous contaminants during processing, the method comprising:

providing a contaminant removal cartridge which selectively couples to the oven and including a heat exchanger and a filter module;

providing a first contaminated air flow at a first temperature from a dwell section of the oven to the heat exchanger and a second contaminated air flow at a second temperature from a cooling section of the oven to the heat exchanger downstream of the first contaminated air flow, the first and second air flows including gaseous contaminants;

cooling the first contaminated air flow to the second temperature before merging the first and second contaminated air flows to form a filtering air flow and cooling the filtering air flow within the heat exchanger so that substantially all of a condensable portion of the gaseous contaminants condense and collect within the heat exchanger;

providing the filtering air flow to the filter module;

absorbing within the filter module substantially all of an odor-causing portion of the gaseous contaminants from the filtering air flow so as to form an exhaust air flow which is substantially free of gaseous contaminants; and replacing the contaminant removal cartridge at a user selected time.

25. The method of claim 24, wherein cooling the filtering air flow includes cooling the filtering air flow to a desired filtering temperature associated with the filter module.

26. The method of claim 24, wherein cooling the first and second contaminated air flows and the filter air flow includes employing a cooling air flow which is substantially at an ambient temperature of an environment in which the thermal processor is operating, wherein the cooling air flow is segregated from and in thermal communication with the first and second contaminated air flows and the filtering air flow.

* * * * *